US005919068A

United States Patent [19]

Schulze

[11] Patent Number: 5,919,068

[45] Date of Patent: Jul. 6, 1999

[54] LIFE RAFT AND METHOD FOR ACTIVATING THE LIFE RAFT

[75] Inventor: Bernd Schulze, Neugersdorf, Germany

[73] Assignee: Deutsche Schlauchbootfabrik Hans Scheibert GmbH & Co. KG, Eschershausen, Germany

[21] Appl. No.: 08/962,412

[22] Filed: Oct. 31, 1997

[30] Foreign Application Priority Data

Nov. 2, 1996 [DE] Germany ..... 196 45 203

[51] Int. Cl.[6] ..... B63B 35/58; B63C 9/04

[52] U.S. Cl. ..... 441/38; 441/41

[58] Field of Search ..... 441/38, 40, 41

[56] References Cited

U.S. PATENT DOCUMENTS

| | | | |
|---|---|---|---|
| 2,908,919 | 10/1959 | Bicknell et al. | 441/38 |
| 3,397,117 | 8/1968 | Smith et al. | 441/38 |
| 4,573,933 | 3/1986 | Cameron | 441/40 |
| 4,998,900 | 3/1991 | Wright | 114/349 |

FOREIGN PATENT DOCUMENTS

| | | | |
|---|---|---|---|
| 261099 | 4/1964 | Australia | 441/38 |

*Primary Examiner*—Sherman Basinger
*Attorney, Agent, or Firm*—Robert W. Becker & Associates

[57] ABSTRACT

In a method for activating a life raft, wherein the life raft has an inflatable bottom frame, a bottom connected to the bottom frame, an inflatable roof structure, including inflatable tubes connected to the bottom frame and a cover connected to the roof structure, wherein the bottom frame and the inflatable roof structure have at least one inflating opening for an inflation medium, it is suggested to first inflate the roof structure in order to facilitate flipping the life raft into the correct position of use.

11 Claims, 1 Drawing Sheet

LIFE RAFT AND METHOD FOR ACTIVATING THE LIFE RAFT

BACKGROUND OF THE INVENTION

The present invention relates to a method for activating an inflatable life raft having an annular flotation body, comprised optionally of two or more inflatable support tubes, and inflatable arc- or V-shaped tubes, positioned above the flotation body and connected with their ends to the flotation body. These arc- or V-shaped tubes are preferably supports for a cover whereby the support tubes and the arc- or V-shaped tubes have one or more filling openings for the inflation medium.

In known life rafts of the aforementioned kind, the V- or arc-shaped tubes are supplied with the inflation medium via the support tubes. Once the support tubes have been filled to a certain inner pressure, the inflation medium can also flow into the V- or arc-shaped tubes. This embodiment has been successful in practice, however, it has disadvantages, for example, when the life raft in a shipwreck situation is positioned upside down before inflation: The support tubes which will be inflated first will prevent the life raft, which is initially positioned flat on the water and exhibits a suction effect with regard to the water surface, from being flipped over into the desired use position or make it at least very difficult.

It is therefore an object of the present invention to avoid these disadvantages. It is desired to embody the life raft such that it will flip automatically from an upside down position into the position of use or at least can be easily flipped over from the upside down position into the position of use.

SUMMARY OF THE INVENTION

The invention concerns a method for activating a life raft that is comprised of an inflatable bottom frame, a bottom connected to the bottom frame, an inflatable roof structure, comprised of inflatable tubes and connected to the bottom frame and a cover connected to the roof structure, wherein the bottom frame and the inflatable roof structure have at least one inflating opening for an inflating medium. The inventive method includes the step of first inflating the roof structure.

Advantageously, the method further includes the step of subsequently inflating the upper support tube of the bottom frame.

Preferably, the method further includes the step of subsequently inflating a lower support tube of the bottom frame.

The method may further include the step of simultaneously inflating at least the upper support tube of the bottom frame.

The present invention also relates to a life raft comprising an inflatable bottom frame, a bottom connected to the bottom frame, an inflatable roof structure, comprised of inflatable tubes connected to the bottom frame and a cover connected to the roof structure, wherein the bottom frame and the inflatable roof structure have at least one inflating opening for an inflating medium. Inventively, at least one first pressure source is directly connected to the roof structure.

Preferably, the bottom frame comprises an upper support tube, and the upper support tube is connected to the roof structure by a check valve or a throttle.

The life raft may further comprise a second pressure source, wherein the bottom frame further comprises a lower support tube and wherein the second pressure source is connected to the lower support tube.

Advantageously, the life raft further comprises separate second pressure sources, wherein the bottom frame consists of a plurality of support tubes and wherein at least one of the separate second pressure sources is connected to each one of the support tubes.

The second pressure sources have differently sized connecting lines for connecting the second pressure sources to the support tubes.

The second pressure sources may have connecting lines with different throttles for connecting the second pressure sources to the support tubes.

Advantageously, the second pressure sources have differently sized connecting lines with different throttles for connecting the second pressure sources to the support tube.

Preferably, inflation of the roof structure and of the bottom frame is time-controlled.

Advantageously, the life raft further comprises an inner support for the cover, wherein the roof structure is arranged externally to the cover.

According to the present invention, the V- or arc-shaped tubes are first inflated, or in the alternative, at least the V- or arc-shaped tubes, on the one hand, and the flotation body, respectively, its support tubes, on the other hand, are practically simultaneously inflated.

Accordingly, it is not the support tubes necessary for flotation that are filled first but instead the V- or arc-shaped inflatable tubes are first inflated. Only thereafter, i.e., when the V- or arc-shaped tubes have already a sufficient envelope stiffness, the support tubes of the flotation body are filled, respectively, their filling is completed.

For performing the inventive method, each tube to be filled (support tubes and V- or arc-shaped tubes) has a pressure medium (inflation medium) bottle with a corresponding connection to the tube. However, it is also possible to provide only one single pressure medium bottle which is then connected via corresponding supply lines to the tubes. It is especially advantageous to design the V- or arc-shaped tubes so as to have a separate pressure medium bottle and to distribute the pressure medium via a valve into the support tubes, respectively, only the upper support tube of the flotation body. In this case, a second lower support tube (when two stacked support tubes are combined in the flotation body), a further pressure medium bottle would be arranged whereby, however, the aforementioned inventive method must be observed with regard to the filling sequence.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
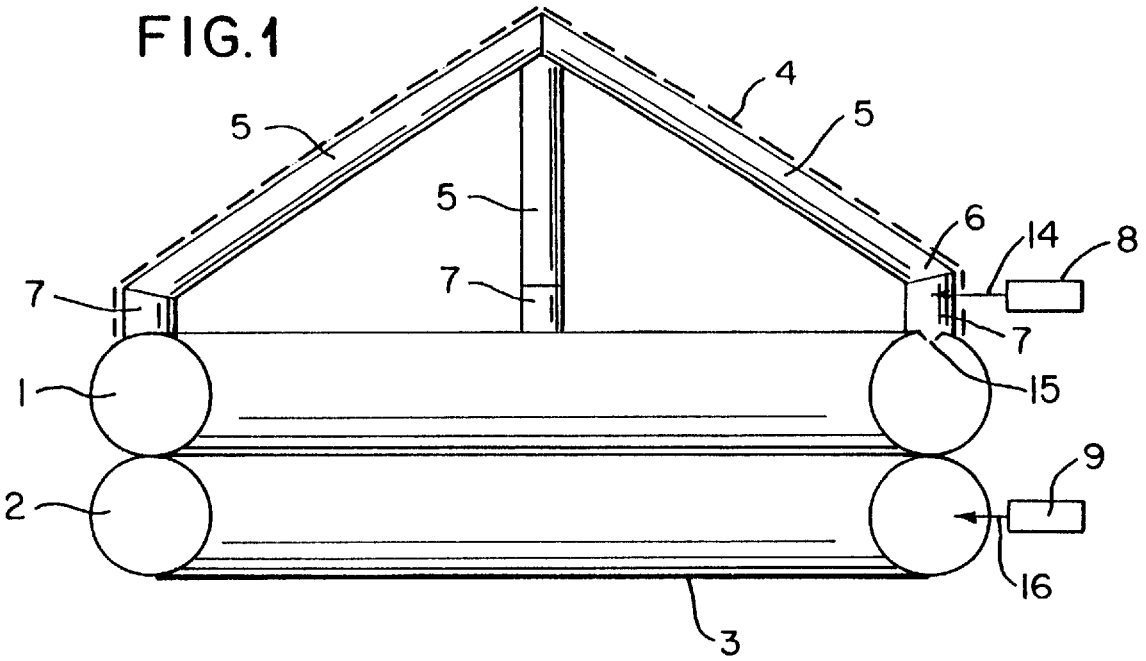
FIG. 1 is a vertical section of a schematically represented inflated life raft.

The present invention will now be described in detail with the aid of several specific embodiments utilizing FIGS. 1 through 3.

The life raft is comprised substantially of a flotation body with two stacked circular (annular), optionally polygonal, support tubes 1, 2 having a bottom 3 connected thereto. A cover 4 with an entry opening is provided on a roof support which is comprised of substantially V-shaped tubes 5. The tip of the V forms the tip of the roof and the ends (6) of the tubes have optionally vertical portions 7 that are connected to the flotation body, respectively, to the upper support tube 1. All these parts are comprised of flexible, foil-like material, for example, a plastic material or a fabric coated with rubber.

The life raft in the stow position is contained in a container. When an emergency situation arises the container is removed and, the life raft is inflated in order to provide a life raft of sufficient envelope stiffness, respectively, stability.

In order to be able to activate the life raft, pressure medium sources in the form of bottles 8, 9, 10, 11, 12, and 13 are provided which are mounted, in general, at the exterior side of the life raft. They contain a pressurized gaseous inflation medium, for example, carbon dioxide.

According to FIG. 1, the bottle 8 is connected by supply line 14 to the inflatable tubes 5 which define a certain hollow space that is connected via the check valve 15 to the support tube 1. The support tube 2 has its own supply bottle 9 connected via line 16. When the life raft is to be activated, the inflation medium is supplied via the supply line to the inflatable tubes 5 whereby only after a certain degree of filling of the tubes 5, i.e., when they have a certain stiffness, the support tube 1 is also filled via the check valve 15. Upon filling of the tube 5, preferably with a time delay, the lower support tube 2 is also filled via the line 16.

Due to the filling of the tubes 5 and due to the resulting bending stiffness, the life raft can no longer rest flat on the water surface in an upside down position. The tubes 5 cause a slanted positioning of the life raft which is, in general, sufficient to cause an automatic flipping of the life raft into the desired use position.

Figure 2:
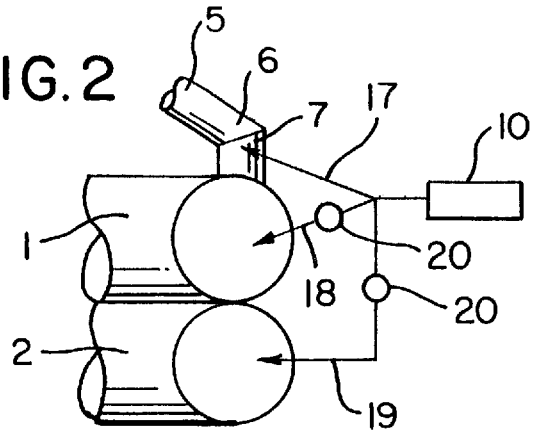
FIGS. 2 and 3 show respective vertical part sectional views of a life raft in different embodiments.

In the embodiment according to FIG. 2, three supply lines 17, 18, and 19 are provided whereby preferably the supply line 17 has a greater diameter or, as represented, the supply lines 18, 19 are provided with throttles or valves 20 in order to prioritize inflation, i.e., have the tubes 5 filled first or simultaneously.

Figure 3:
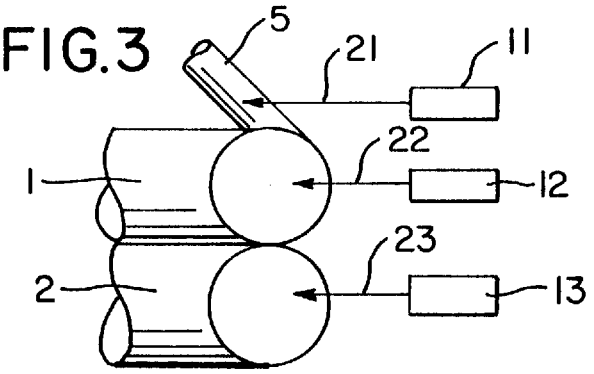

According to FIG. 3, three bottles 11, 12, 13 are installed which are connected by supply lines 21, 22, and 23 to the respective tubes (1, 2, 5). In this case, it is suggested to control timing of the supply, for example, by a delay switch, and/or, to dimension the supply lines 21 to 23 accordingly. Expediently, the tubes 5, then the tube 1, and finally the tube 2 are to be inflated in sequence to reach shape-stiffness.

Even though the aforementioned V- or arc-shaped tubes 5 provide advantageously a support for the cover, it may be advantageous to position them above the cover and to provide an additional support for the cover consisting of different tubes etc.

It should be noted that in the embodiment according to FIG. 1, instead of the two bottles 8, 9, only one bottle could be used by connecting the two supply lines 14, 16 to a single bottle. Similarly, the embodiment according to FIG. 3 can be changed in that a single bottle is substituted for the two bottles 12, 13. This means that the supply lines 22, 23 must be connected to the single bottle. It is understood that the realization of the instant invention can make use of throttles, delay members etc. in order to comply with the inventive concept.

The present invention is, of course, in no way restricted to the specific disclosure of the specification and drawings, but also encompasses any modifications within the scope of the appended claims.

What is claimed is:

1. A method for activating a life raft, said life raft comprised of an inflatable bottom frame, a bottom connected to said bottom frame, an inflatable roof structure, comprised of inflatable tubes connected to said bottom frame and a cover connected to said roof structure, wherein said bottom frame and said inflatable roof structure have at least one inflating opening for an inflating medium, said method comprising the steps of:

first inflating said roof structure;

subsequently inflating an upper support tube of said bottom frame, and subsequently inflating a lower support tube of said bottom frame.

2. A life raft comprising:

an inflatable bottom frame, a bottom connected to said bottom frame, an inflatable roof structure, comprised of inflatable tubes connected to said bottom frame and a cover connected to said roof structure, wherein said bottom frame and said inflatable roof structure have at least one inflating opening for an inflating medium, and at least one first pressure source directly connected to said roof structure;

separate second pressure sources, wherein said bottom frame consists of a plurality of support tubes and wherein at least one of said separate second pressure sources is connected to each one of said support tubes; and wherein said second pressure sources have differently sized connecting lines for connecting said second pressure sources to said support tubes.

3. A life raft according to claim 2, wherein said plurality of said support tubes comprises an upper support tube and wherein said upper support tube is connected to said roof structure by a check valve or a throttle.

4. A life raft according to claim 2, wherein said plurality of said support tubes comprises a lower support tube and wherein one of said second pressure sources is connected to said lower support tube.

5. A life raft comprising:

an inflatable bottom frame, a bottom connected to said bottom frame, an inflatable roof structure, comprised of inflatable tubes connected to said bottom frame and a cover connected to said roof structure, wherein said bottom frame and said inflatable roof structure have at least one inflating opening for an inflating medium, and at least one first pressure source directly connected to said roof structure;

separate second pressure sources, wherein said bottom frame consists of a plurality of support tubes and wherein at least one of said separate second pressure sources is connected to each one of said support tubes; and wherein said second pressure sources have connecting lines with different throttles for connecting said second pressure sources to said support tubes.

6. A life raft according to claim 2, wherein said differently sized connecting lines have different throttles for connecting said second pressure sources to said support tubes.

7. A life raft according to claim 2, wherein inflation of said roof structure and of said bottom frame is time-controlled.

8. A life raft according to claim 5, wherein said connecting lines are sized differently.

9. A life raft according to claim 5, wherein said plurality of said support tubes comprises an upper support tube and wherein said upper support tube is connected to said roof structure by a check valve or a throttle.

10. A life raft according to claim 5, wherein said plurality of said support tubes comprises a lower support tube and wherein one of said second pressure sources is connected to said lower support tube.

11. A life raft according to claim 5, wherein inflation of said roof structure and of said bottom frame is time-controlled.

* * * * *